US012449233B1

(12) United States Patent
Schmidt et al.

(10) Patent No.: US 12,449,233 B1
(45) Date of Patent: Oct. 21, 2025

(54) GUN SIGHT OPTIC CONTINGENCY SYSTEM

(71) Applicant: Patnik Solutions LLC, Hopkins, MN (US)

(72) Inventors: Nicholas A. Schmidt, Hopkins, MN (US); Patrick W. Anderson, Maple Grove, MN (US)

(73) Assignee: Patnik Solutions LLC, Hopkins, MN (US)

( * ) Notice: Subject to any disclaimer, the term of this patent is extended or adjusted under 35 U.S.C. 154(b) by 1 day.

(21) Appl. No.: 18/642,787

(22) Filed: Apr. 22, 2024

Related U.S. Application Data

(60) Provisional application No. 63/497,557, filed on Apr. 21, 2023.

(51) Int. Cl.

| | |
|---|---|
| ***F41G 1/00*** | (2006.01) |
| ***F41G 1/01*** | (2006.01) |
| ***F41G 1/30*** | (2006.01) |
| ***F41G 1/34*** | (2006.01) |

(52) U.S. Cl.
CPC ..... *F41G 1/01* (2013.01); *F41G 1/30* (2013.01); *F41G 1/345* (2013.01)

(58) Field of Classification Search
CPC . F41G 1/38; F41G 1/345; F41G 1/473; F41G 1/30; F41G 3/08; F41G 11/003; F41G 1/01; F41G 1/387; F41G 3/06
USPC ..... 42/111, 118, 132, 122, 124, 123, 130, 42/144, 113, 145
See application file for complete search history.

(56) References Cited

U.S. PATENT DOCUMENTS

| | | | |
|---|---|---|---|
| 2,706,335 | A | 4/1955 | Munsey |
| 2,763,930 | A | 9/1956 | Ivy |
| 2,806,288 | A | 9/1957 | Sarvis |
| 2,825,138 | A | 3/1958 | Ivy |
| 3,187,436 | A | 6/1965 | Friedrichsmeier |
| 3,463,430 | A | 8/1969 | Rubin et al. |
| 3,499,224 | A | 3/1970 | Squier et al. |
| 3,555,687 | A | 1/1971 | Joseph |
| 3,641,676 | A | 2/1972 | Knutsen et al. |
| 3,700,339 | A | 10/1972 | Steck |
| 3,820,248 | A | 6/1974 | Hayward |
| 3,835,565 | A | 9/1974 | Weast |
| 3,875,675 | A | 4/1975 | Krisay |
| 3,914,873 | A | 10/1975 | Elliott, Jr. et al. |
| 4,026,055 | A | 5/1977 | Weast |
| 4,299,044 | A | 11/1981 | Johannsen |
| 4,418,487 | A | 12/1983 | Strahan |

(Continued)

*Primary Examiner* — Michael D David
(74) *Attorney, Agent, or Firm* — Albert W. Watkins

(57) ABSTRACT

A gun sight optic contingency system is mounted co-witnessed with a red dot sight onto a firearm. The red dot sight has a sight window that remains functionally unobstructed. The gun sight optic contingency system has a low profile rear sight located proximal to a shooter, and a front sight located distally to the shooter. The rear and front sights together define a sighting axis aligned with the path a fired projectile takes. Amounting, such as an adapter plate, couples to the firearm. When aimed at a target, the front sight is visible within and adjacent to a bottom of the view visible in the sight window. The rear sight is outside of and adjacent to a bottom of the sight window and also adjacent to and just below the front sight view in the sight window. The front and rear sights may contain a luminescent compound.

18 Claims, 2 Drawing Sheets

(56) References Cited

U.S. PATENT DOCUMENTS 4,429,468 A 2/1984 Jimenez et al.
4,509,282 A 4/1985 Mcmillon
4,535,544 A 8/1985 Jones et al.
4,601,121 A 7/1986 Jolly
4,688,345 A 8/1987 Kilgour
4,841,659 A 6/1989 Williams
4,873,779 A 10/1989 Ellison et al.
4,877,324 A 10/1989 Hauri et al.
4,894,941 A 1/1990 Karow, Jr.
5,157,839 A 10/1992 Beutler
5,339,227 A 8/1994 Jones
5,491,546 A 2/1996 Wascher et al.
5,595,011 A 1/1997 Gorslin
D382,038 S 8/1997 Nigh
5,735,070 A 4/1998 Vasquez et al.
5,806,228 A 9/1998 Martel et al.
5,887,352 A 3/1999 Kim
5,920,995 A 7/1999 Sammut
5,941,006 A 8/1999 Horton
5,956,854 A 9/1999 Lorocco
6,032,374 A 3/2000 Sammut
6,058,616 A 5/2000 Bubits
6,068,483 A 5/2000 Minor
6,122,833 A 9/2000 Lorocco
6,216,351 B1 4/2001 Flubacher et al.
6,216,352 B1 4/2001 Lorocco
6,336,285 B1 1/2002 Baumer
6,357,158 B1 3/2002 Smith, III
6,360,471 B1 3/2002 Stein
6,360,472 B1 3/2002 Lorocco
6,418,657 B1 7/2002 Brown
6,453,595 B1 9/2002 Sammut
6,516,551 B2 2/2003 Gaber
6,516,699 B2 2/2003 Sammut et al.
6,604,315 B1 8/2003 Smith et al.
6,681,512 B2 1/2004 Sammut
6,711,846 B1 3/2004 Nasef
6,769,210 B2 8/2004 Bubits
6,802,131 B1 10/2004 Scholz et al.
6,886,288 B1 5/2005 Yocum et al.
7,100,320 B2 9/2006 Verdugo
7,308,891 B2 12/2007 Graf
7,434,345 B2 10/2008 Verdugo
7,451,566 B1 11/2008 Price
7,603,804 B2 10/2009 Zaderey et al.
7,654,029 B2 2/2010 Peters et al.
7,676,137 B2 3/2010 Schick et al.
7,676,981 B2 3/2010 Buckingham et al.
7,685,760 B1 3/2010 Neumaster
7,690,145 B2 4/2010 Peters et al.
7,721,479 B2 5/2010 Schulst
7,739,825 B2 6/2010 Lorocco
7,743,546 B2 6/2010 Keng
7,765,730 B2 8/2010 Keng
7,793,456 B1 9/2010 Lacorte
7,821,708 B2 10/2010 Robitaille
7,832,137 B2 11/2010 Sammut et al.
7,832,138 B1 11/2010 Price
7,856,750 B2 12/2010 Sammut et al.
7,934,334 B2 5/2011 Kraft
7,937,878 B2 5/2011 Sammut et al.
7,946,075 B2 5/2011 Nasef
8,009,958 B1 8/2011 Schick et al.
8,037,634 B2 10/2011 Price
8,046,951 B2 11/2011 Peters et al.
8,091,268 B2 1/2012 York
8,104,218 B2 1/2012 Mccann
8,109,029 B1 2/2012 Sammut et al.
8,151,510 B2 4/2012 Capson
8,230,635 B2 7/2012 Sammut et al.
8,230,637 B2 7/2012 Lamb
8,254,746 B2 8/2012 Schick et al.
8,286,384 B2 10/2012 Zaderey et al.
8,353,454 B2 1/2013 Sammut et al.
8,364,002 B2 1/2013 Schick et al.
8,393,108 B1 3/2013 Wilson
8,425,063 B2 4/2013 Buckingham et al.
8,437,079 B2 5/2013 Wu
8,448,372 B2 5/2013 Peters et al.
8,656,630 B2 2/2014 Sammut
8,707,608 B2 4/2014 Sammut et al.
8,720,103 B2 5/2014 Schultz et al.
8,726,562 B1 5/2014 Hoskisson
8,769,858 B2 7/2014 Hancosky
8,863,433 B2 10/2014 Kruse
8,893,971 B1 11/2014 Sammut et al.
8,905,307 B2 12/2014 Sammut et al.
8,919,027 B2 12/2014 Curry
8,959,823 B2 2/2015 Peters et al.
8,959,824 B2 2/2015 Sammut et al.
8,966,806 B2 3/2015 Sammut et al.
8,978,539 B2 3/2015 Teetzel et al.
8,984,797 B2 3/2015 Ballard
8,991,702 B1 3/2015 Sammut et al.
9,052,160 B1 6/2015 Gordon
9,068,794 B1 6/2015 Sammut
9,091,507 B2 7/2015 Paterson et al.
9,115,958 B2 8/2015 Crispin
9,222,753 B2 12/2015 Hornung et al.
9,250,038 B2 2/2016 Sammut et al.
9,273,930 B2 3/2016 Jiminez et al.
9,303,951 B2 4/2016 Hancosky et al.
9,335,123 B2 5/2016 Sammut
9,360,278 B2 6/2016 Mansfield
9,372,049 B2 6/2016 Cheng et al.
9,395,156 B2 7/2016 Newzella et al.
9,423,212 B2 8/2016 Campean
9,435,612 B2 9/2016 Hancosky
9,453,706 B1 * 9/2016 Crispin ..... F41G 1/26
9,482,489 B2 11/2016 Peters et al.
9,568,277 B2 2/2017 Crispin
9,574,850 B2 2/2017 Sammut et al.
D784,481 S 4/2017 Ding et al.
D784,483 S 4/2017 Ding et al.
D787,007 S 5/2017 Maughn
9,696,114 B1 * 7/2017 Cabrera ..... F41G 1/10
9,696,115 B2 7/2017 Nigro
9,777,994 B2 10/2017 Hancosky
9,823,044 B1 * 11/2017 Cabrera ..... F41G 1/17
9,903,686 B2 2/2018 Maynard
10,175,029 B2 1/2019 Teetzel et al.
10,337,837 B2 7/2019 Keller et al.
10,352,654 B2 7/2019 Costet et al.
10,520,716 B2 12/2019 Havens et al.
10,684,100 B2 6/2020 Pniel et al.
10,830,560 B2 11/2020 Barnett et al.
D907,161 S 1/2021 Chin
10,900,745 B2 1/2021 Hamilton et al.
10,942,005 B2 3/2021 Teetzel et al.
D917,651 S 4/2021 Huang
11,118,860 B2 9/2021 Zimmer
11,131,526 B2 9/2021 Shawley et al.
11,268,787 B1 3/2022 Bernkrant et al.
11,365,954 B2 6/2022 Gerber et al.
11,460,274 B2 * 10/2022 Dawson, Jr. ..... F41G 11/001
2002/0078618 A1 6/2002 Gaber
2002/0124452 A1 9/2002 Sammut
2004/0010956 A1 1/2004 Bubits
2005/0229468 A1 10/2005 Zaderey et al.
2006/0026887 A1 2/2006 Verdugo
2006/0096150 A1 5/2006 Graf
2006/0207157 A1 9/2006 Keng
2007/0022651 A1 2/2007 Verdugo
2007/0044364 A1 3/2007 Sammut et al.
2007/0074441 A1 4/2007 Howe
2007/0137088 A1 6/2007 Peters et al.
2008/0092423 A1 4/2008 Keng
2008/0098640 A1 5/2008 Sammut et al.
2008/0295380 A1 12/2008 Buckingham et al.
2009/0019758 A1 1/2009 Baugher
2009/0100735 A1 4/2009 Schick et al.
2009/0199451 A1 8/2009 Zaderey et al.
2009/0199702 A1 8/2009 Zaderey et al.
2009/0200376 A1 8/2009 Peters et al.

(56) References Cited

U.S. PATENT DOCUMENTS

2009/0235570 A1 9/2009 Sammut et al.
2010/0077647 A1 4/2010 Kraft
2010/0170136 A1 7/2010 Buckingham et al.
2010/0282845 A1 11/2010 Peters et al.
2011/0067286 A1 3/2011 Price
2011/0067288 A1* 3/2011 Hakansson ..... G02B 23/105 349/196
2011/0088306 A1 4/2011 Nasef
2011/0089238 A1 4/2011 Sammut et al.
2011/0132983 A1 6/2011 Sammut et al.
2011/0197491 A1 8/2011 McCann
2011/0296733 A1 12/2011 York
2011/0314721 A1 12/2011 Lamb
2012/0047788 A1 3/2012 Capson
2012/0137567 A1 6/2012 Sammut
2012/0198750 A1 8/2012 Mansfield
2012/0246992 A1 10/2012 Peters et al.
2013/0014421 A1 1/2013 Sammut et al.
2013/0074394 A1 3/2013 Larue
2013/0185985 A1 7/2013 Ballard
2013/0199074 A1 8/2013 Paterson et al.
2013/0255129 A1 10/2013 Curry
2013/0263491 A1 10/2013 Jung et al.
2013/0333266 A1 12/2013 Gose et al.
2014/0007486 A1 1/2014 Hornung et al.
2014/0041277 A1 2/2014 Hamilton
2014/0059914 A1 3/2014 Sammut et al.
2014/0059915 A1 3/2014 Sammut et al.
2014/0068994 A1 3/2014 Schultz et al.
2014/0096430 A1 4/2014 Kruse
2014/0109459 A1 4/2014 Sammut et al.
2014/0123533 A1 5/2014 Sammut et al.
2014/0157644 A1 6/2014 Jiminez et al.
2014/0259853 A1* 9/2014 Crispin ..... G02B 23/14 42/124
2014/0360083 A1 12/2014 Sammut
2015/0013206 A1 1/2015 Peters et al.
2015/0020431 A1 1/2015 Sammut et al.
2015/0153137 A1 6/2015 Newzella et al.
2015/0192390 A1 7/2015 Pedack et al.
2015/0198415 A1 7/2015 Campean
2015/0198419 A1 7/2015 Sammut
2015/0276346 A1 10/2015 Hamilton et al.
2015/0345901 A1 12/2015 Cheng et al.
2015/0345905 A1 12/2015 Hancosky
2015/0362287 A1 12/2015 Sammut et al.
2016/0047624 A1 2/2016 Hancosky
2016/0061568 A1 3/2016 Crispin
2016/0146575 A1 5/2016 Maynard
2016/0169620 A1 6/2016 Nigro
2016/0178320 A1 6/2016 Hancosky
2016/0178321 A1 6/2016 Peters et al.
2016/0377380 A1 12/2016 Sammut
2017/0023332 A1* 1/2017 Campbell ..... F41G 1/30
2017/0205194 A1 7/2017 Teetzel et al.
2017/0321993 A1* 11/2017 Crispin ..... G02B 23/14
2018/0180386 A1 6/2018 Keller et al.
2019/0049217 A1 2/2019 Costet et al.
2019/0120594 A1 4/2019 Teetzel et al.
2019/0145735 A1 5/2019 Hancosky
2019/0146205 A1 5/2019 Havens et al.
2019/0186870 A1 6/2019 Barnett et al.
2019/0323795 A1 10/2019 Zimmer
2019/0383578 A1* 12/2019 Mills ..... G02B 17/0808
2020/0025514 A1 1/2020 Johnson
2021/0033369 A1 2/2021 Shawley et al.
2021/0270572 A1 9/2021 Dawson, Jr.
2022/0034629 A1* 2/2022 Hamilton ..... F41G 1/30
2022/0113114 A1 4/2022 Humphries
2022/0163292 A1 5/2022 Kilic
2022/0390206 A1 12/2022 Hamilton
2023/0011632 A1* 1/2023 Salinas ..... F41A 21/36
2023/0185074 A1* 6/2023 Crispin ..... F41G 1/345 359/428
2023/0272999 A1* 8/2023 Campbell ..... F41G 1/32 89/41.05
2024/0271907 A1* 8/2024 Enzinger ..... F41G 1/38
2025/0004285 A1* 1/2025 Havens ..... G02B 27/0172
2025/0060194 A1* 2/2025 Underwood ..... F41G 1/34

* cited by examiner

GUN SIGHT OPTIC CONTINGENCY SYSTEM

CROSS REFERENCE TO RELATED APPLICATIONS

The present application claims the benefit of U.S. provisional patent application 63/497,557 filed Apr. 21, 2023 of like title and inventorship, the teachings and entire contents which are incorporated herein by reference.

BACKGROUND OF THE INVENTION

1. Field of the Invention

The field of the invention pertains generally to firearms, and in a more particular manifestation to sighting devices for aiming a pistol.

2. Description of the Related Art

To safely and effectively use a firearm, one of the most important things is to identify where a bullet or other projectile will strike after firing. To facilitate this identification, some type of gun sight is most commonly provided.

One very common sight is known as an iron sight, which defines at least two stationary visual references on the gun. A rear sight is closest to the shooter, while a front sight is commonly proximal to the muzzle, relatively more distal to the shooter. The rear and front sights or visual references must be brought in line with the eye to create a sight picture and identify the likely location that a fired round will strike. One drawback of this sort of sight is it requires aligning three references, the two iron sights and the target. All three have to be simultaneously aligned to generate an accurate shot. This necessarily requires a shooter to first align one of the sights with the target, and then to try to keep that sight in alignment while adjusting the angle or tilt of the gun to also bring the other sight into alignment with the target. The challenge of this three-point alignment is both apparent from the foregoing description and well known to persons who have fired a pistol. Recognizing the challenges, persons who wish to become or remain proficient in firing a pistol accurately spend many hours both training and refreshing their training at the firing range.

Another drawback of iron sights is that they are most commonly fabricated from opaque materials that are difficult or impossible to see in low ambient light conditions. Most self-defense shootings occur in these very same low ambient light conditions. To solve this low-light challenge, iron sights may also include accessories and enhancements. Various highly-skilled artisans have provided luminescent materials on the iron sights to make them visible in low light or dark conditions, while other highly-skilled artisans have provided contrasting paints and finishes, or supplemental electrical light sources. Some exemplary patents, the teachings and contents which are incorporated herein by reference, include: U.S. Pat. No. 3,187,436 by Friedrichsmeier, entitled "Contrasting color gun sight"; U.S. Pat. No. 3,820,248 by Hayward, entitled "Illuminated gun sight"; U.S. Pat. No. 5,956,854 by Lorocco, entitled "Day/night weapon sight"; and, U.S. Pat. No. 6,711,846 by Nasef, entitled "Gun sight system".

These sights are referred to generically as iron sights, because they are commonly though not always fabricated from iron. For the purposes of the present disclosure, "iron sights" will be understood to refer to sights using mechanical features and apparatus that define the visual references used by a shooter, irrespective of whether fabricated from iron, other metals or metal alloys, plastic, ceramic, or other suitable materials. Iron sights can be directly affixed to a pistol, or may have an adapter plate or accessory rail that is intermediate between the pistol and sight.

Advancements in optics have led to the development of a more efficient sight known as a reflex sight, but more commonly referred to as a "red dot" sight. Red dot sights are well known in the field and multiple variations exist. They usually provide no magnification, and provide a high level of accuracy while being relatively easy to use. These sights are called red dot sights because they originated and continue to be commonly provided with red lights such as a red LED or laser as the illumination source. Red light sources are of generally low cost, are readily available, and also are commonly considered to be least disruptive of low-light and general vision. Nevertheless, these reflex sights could use other visible light colors.

A red dot sight generates an illuminated dot or similar aiming mark on an optical surface, through which the target is visible. When a shooter aligns the illuminated dot with the target, the shooter knows the gun is aimed at the target. When the trigger is subsequently pulled, a bullet will likely strike the intended target.

One consideration for the efficacy of a gun sight is the "time to engagement", which measures the time required for a shooter to align the gun to an intended target. In the case of a reflex sight, a shooter will first draw the gun into rough alignment so that the target is visible through the sight, and then subsequently align the red dot with the target. The rough initial alignment of a gun equipped with a red dot sight to a target can be done quickly and with little concern for accuracy or precision. When the target is visible through the sight window, the shooter will then be able to very rapidly and precisely align the illuminated dot with the target.

For many people, this process is faster and more direct than sighting with iron sights. A person only has to focus on the target and bring the red dot into position, versus focusing on the target and front iron sight, getting those aligned, and then having to bring the rear iron sight into position while still focusing on keeping the front sight and target aligned. As a result of only aligning two reference points instead of having to shift focus between the three or more reference points generally required by iron sights, red dot sights are generally accepted as being both easier and faster to align for both novices and experts. Furthermore, while a trained individual will have muscle memory that can make either a red dot or iron sight sequence very fast, even a novice or someone with bifocals or trifocals can be fast with a red dot sight, as long as the shooter can quickly aim the gun sufficiently to bring the target into the red dot sight window.

Because of the improved ease of alignment of the dot and the target and the reduced time to engagement, a red dot sight is preferred for most applications over iron sights.

While red dot sights are generally easier and quicker to use, they are less reliable than iron sights. Failures can occur for a variety of reasons, for exemplary and non-limiting purpose including a dead battery, insufficient contrast with background light, broken optics or electronics, and other reasons. If a red dot sight is the only sighting apparatus, the firearm becomes effectively disabled for all but point blank range when the red dot sight fails.

In many of these cases, including that of a dead battery, insufficient contrast, and broken electronics, the fact that the firearm is disabled isn't always immediately apparent to a shooter. There is a limited range in which the red dot sights have a visible "red dot", and if the gun is not sufficiently aligned, the red dot is not visible. Consequently, a shooter will not immediately know that the red dot sight has failed, and may instead waste precious time trying to manipulate the pistol position to try to reveal the red dot.

This reliability problem is already well known, and various highly-skilled artisans have proposed different solutions. One solution is to co-witness other sights, including iron sights, with red dot sights. Exemplary U.S. patents and published applications, the teachings which are incorporated herein by reference, include: U.S. Pat. No. 6,418,657 by Brown, entitled "Sight mount for a firearm"; U.S. Pat. No. 9,372,049 by Cheng et al, entitled "Handle sight"; U.S. Pat. No. 9,423,212 by Campean entitled "Reflex Sight Adjustments"; U.S. Pat. No. 10,175,029 by Teetzel et al. entitled "Combined Reflex and Laser Sight with Co-Aligned Iron Sights"; U.S. Pat. No. 10,337,837 by Keller et al. entitled "Flip Sight Systems for Firearms"; U.S. Pat. No. 10,352,654 by Costet et al. entitled "Firearm With Interchangeable Sighting Device System"; U.S. Pat. No. 10,830,560 by Barnett et al, entitled "Firearm sight assembly"; U.S. Pat. No. 10,942,005 by Teetzel et al, entitled "Combined reflex and laser sight with co-aligned iron sights"; U.S. Pat. No. 11,268,787 by Bernkrant et al, entitled "Fast acquiring gun sight"; U.S. Pat. No. 11,460,274 by Dawson, Jr., entitled "Sighting systems, components, and methods"; 2013/0074394 by Larue, entitled "Mount for co-witnessing sighting devices for firearms having sheet metal receiver covers"; and 2022/0034629 by Hamilton, entitled "Integrated optical sighting system for firearm".

Prior art FIG. 3 illustrates an exemplary prior art rear iron sight 5 mounted to a pistol 1 with a red dot sight 3. However, rear iron sight 5 obstructs at least a part of the view of the reflex sight. As a result, the very benefits that the reflex sight would otherwise obtain are reduced by the obstructing rear iron sight 5, in particular including the time to engagement, since a shooter might not see the red dot if the dot is in the obstructed portion of the optical surface.

Describing one aiming and firing sequence performed by a trained shooter using the prior art iron sights 2, 5 and red dot sight 3 of FIG. 3, the shooter will raise pistol 1 with only one eye open, such that the sights 2, 3, and 5 are aligned well above the intended target. This allows a shooter to see front iron sight 2 and the target, while looking over both of the red dot sight 3 and prior art rear iron sight 5. Then they will squeeze the grip with their pinky finger, which pulls the shot elevation down, bringing the red dot and iron sights into alignment with the target.

When a well trained iron sight shooter uses the aforementioned technique they will still benefit from the red dot sight, but they might not be taking full advantage of the red dot sight. One known shooting sequence for a red dot sight is to maintain focus on the target with both eyes and bring the gun up into position at which point a shooter's prior training for eye hand coordination should make the red dot visible to one of the shooter's eyes. Once the red dot and target become visible, the shooter can make any last adjustments to the position of the gun to bring the red dot to the desired location. This red dot shooting technique when employed by a practiced shooter can be faster and more reliably accurate with less training time than iron sight shooting.

Unfortunately, when a shooter using the iron sight sequence notices that the red dot hasn't appeared after pulling their pinky finger, they will undoubtedly try to re-aim to see if the red dot is just out of view. Since the prior art co-witnessed iron sights block a significant portion of the red dot view window, confusion is more likely to occur with co-witnessing. Similarly, a red dot shooter is trained to re-present the weapon by bringing the gun close to their chest and then re-extending the gun if they do not see the red dot. A poorly trained or novice red dot shooter can spend much time trying to manipulate the pistol position to reveal the red dot, once again to no avail if the red dot sight has malfunctioned. Both of these practices wastes some precious time.

Further compounding the problem of a failed red dot sight on guns with co-witnessed iron sights, a shooter has to find a point of aim. "Point of aim" is defined by front iron sight 2. This may require the closing or ignoring of one eye, and bringing the gun into a new shooting position. However, not only does larger prior art rear iron sight 5 obstruct the view of the red dot, it can also obstruct the view of front iron sight 2, making it harder to find the front sight and target. Consequently, this prior art rear iron sight 5 will in at least some cases force the shooter to re-tilt the pistol so that the front iron sight is once again aligned well above the intended target. Then the shooter will squeeze their pinky and this time align the prior art rear iron sight 5 with the front iron sight 2. Not only will the shooter lose precious time trying to find a non-existent red dot, in at least some instances they will also have to repeat the raising and subsequent lowering of the muzzle-end of the pistol.

While the shown prior art co-witnessed iron sight with red dot sight 5 is what is referred to as a lower third co-witness sight, there also exist lower quarter, lower fifth, or lower half co-witnessed iron sights with red dot sights. All of these sights provide a noticeably restricted sight window for the red dot sight and thus make them less than ideal for a person using the red dot sight as the primary sight.

One solution to restricted sight windows for a red dot sight proposed by various highly-skilled artisans is to offset the targeting axis of a back-up iron sight from the targeting axis of a reflex sight. In these inventions, the iron sights might have an axis offset above or below that of the reflex sight. Exemplary U.S. patents and published applications, the teachings which are incorporated herein by reference, include: U.S. Pat. No. 8,393,108 by Wilson, entitled "Universal Quick Mounting, No Bolts Gunsight Mount"; U.S. Pat. No. 11,131,526 by Shawley et al, entitled "Handgun slide with embedded sight assembly"; and 2022/0163292 by Kilic, entitled "Device for attaching a sight to a handgun". While these approaches preserve the full functionality and benefits of the reflex sight, in the event of a failure of the reflex sight the shooter must spend substantial, and potentially precious, time shifting the firearm to realign the shooter's eye with the offset axis. Further, and as with the reflex sight without a back-up sight, the shooter will not immediately know that the red dot has failed, since the iron sights are not co-witnessed therewith and so there is no point of reference to know for sure whether the red dot should be visible.

Another approach in the prior art is to offset the axis of iron sights from optical sights or other firearm additions, such as shifting them above, below, to the side, and other shifted axes. Exemplary U.S. patents and published applications, the teachings which are incorporated herein by reference, include: U.S. Pat. No. 2,763,930 by Ivy, entitled "Detachable top mount"; U.S. Pat. No. 2,825,138 by Ivy, entitled "Telescope mounting bar"; U.S. Pat. No. 3,463,430 by Rubin et al, entitled "Mounting Means for Rifle Telescopic Sights"; U.S. Pat. No. 3,555,687 by Joseph, entitled "Firearm mounting for sighting device"; U.S. Pat. No.

3,835,565 by Weast, entitled "Telescopic sight mounting"; U.S. Pat. No. 3,875,675 by Krisay, entitled "All weather scope mounting base"; U.S. Pat. No. 4,026,055 by Weast, entitled "Telescopic sight mounting"; U.S. Pat. No. 4,299,044 by Johannsen, entitled "Telescopic sight mount for firearms"; U.S. Pat. No. 4,418,487 by Strahan, entitled "Mounting bracket for gunsight"; U.S. Pat. No. 4,429,468 by Jimenez et al, entitled "See-through type telescope sight mount for firearms"; U.S. Pat. No. 4,509,282 by McMillon, entitled "Sight and scope conversion mounting"; U.S. Pat. No. 4,688,345 by Kilgour, entitled "Telescopic sight mount"; U.S. Pat. No. 4,841,659 by Williams, entitled "Sight over scope gun sight"; U.S. Pat. No. 4,873,779 by Ellison et al, entitled "Scope mount base for a black powder rifle"; U.S. Pat. No. 4,894,941 by Karow, Jr., entitled "Device for releasably securing a flashlight or the like to a firearm"; U.S. Pat. No. 5,595,011 by Gorslin, entitled "Telescopic-sight system for AK47-type rifles"; U.S. Pat. No. 5,806,228 by Martel et al, entitled "Scope mount for the carrying handle of M-16 type rifles"; U.S. Pat. No. 5,941,006 by Horton, entitled "Top mount for offset telescopic sight"; U.S. Pat. No. 6,336,285 by Baumer, entitled "Sighting apparatus"; U.S. Pat. No. 6,886,288 by Yocum et al, entitled "Device for mounting a scope to carrying handle of a rifle"; U.S. Pat. No. 7,765,730 by Keng entitled "Assault Rifle Back-up Sight Rib and Support Structure"; U.S. Pat. No. 8,104,218 by McCann, entitled "Firearm accessory rail with integral sight elements"; U.S. Pat. No. 8,720,103 by Schultz et al, entitled "Firearm scope mount"; U.S. Pat. No. 8,726,562 by Hoskisson, entitled "Optics mount for a firearm"; U.S. Pat. No. 8,978,539 by Teetzel et al, entitled "Weapon video display system employing smartphone or other portable computing device"; U.S. Pat. No. 8,984,797 by Ballard, entitled "Articulating targeting device for firearms and the like"; U.S. Pat. No. 9,273,930 by Jiminez et al, entitled "Single Mount for Attaching Accessories to a Picatinny Type Rail of a Hand Gun"; U.S. Pat. No. 10,684,100 by Pniel et al, entitled "Small fire-arm sight mount"; U.S. Pat. No. 11,118,860 by Zimmer, entitled "Shoulder stock assembly for a pistol"; U.S. Pat. No. 11,365,954 by Gerber et al, entitled "Firearm optic assembly"; 2009/0019758 by Baugher, entitled "Lens to assist in shooting of a gun"; 2022/0113114 by Humphries, entitled "Scope mount apparatus and method"; 2022/0390206 by Hamilton, entitled "Passively illuminated fiber optic reflex sights for firearms"; Des. 784,481 by Ding et al, entitled "Slim riser mount"; Des. 784,483 by Ding et al, entitled "Slim riser mount"; Des. 787,007 by Maughn, entitled "Scope mount"; Des. 907,161 by Chin, entitled "Optics adapter"; and Des. 917,651 by Huang, entitled "Sight".

In addition to the aforementioned patents the following patents describe an illuminated iron sight. Exemplary U.S. patents and published applications, the teachings which are incorporated herein by reference and some of which may be duplicative of those listed herein above, include: U.S. Pat. No. 3,641,676 by Knutsen et al, entitled "Radioluminescent gunsight and method"; U.S. Pat. No. 3,914,873 by Elliott Jr et al, entitled "Illuminated gun sights"; U.S. Pat. No. 4,601,121 by Jolly, entitled "Triangular gun sight"; U.S. Pat. No. 5,735,070 by Vasquez et al, entitled "Illuminated gun sight and low ammunition warning assembly for firearms"; U.S. Pat. No. 5,887,352 by Kim, entitled "Gun sight system"; U.S. Pat. No. 6,058,616 by Bubits, entitled "Sighting device for small arms"; U.S. Pat. No. 6,068,483 by Minor, entitled "Simulated firearm sight alignment training system"; U.S. Pat. No. 6,216,351 by Flubacher et al, entitled "Day and night weapon sights"; U.S. Pat. No. 6,216,352 by Lorocco, entitled "Day/night weapon sight"; U.S. Pat. No. 7,934,334 by Kraft, entitled "Aiming systems"; U.S. Pat. No. 8,230,637 by Lamb, entitled "High-visibility gunsight"; U.S. Pat. No. 8,919,027 by Curry, entitled "Firearm and air gun sight"; U.S. Pat. No. 9,360,278 by Lee, entitled "Sight apparatus and related methods"; U.S. Pat. No. 9,395,156 by Newzella et al, entitled "Fire control sight, hand-held firearm and a method for orienting a hand-held firearm"; 2007/0074441 by Howe, entitled "Rear CQB Sight and System"; 2010/0077647 by Kraft, entitled "Aiming system"; 2011/0314721 by Lamb, entitled "High visibility gunsight"; 2012/0198750 by Mansfield, entitled "Sight apparatus and related methods"; 2013/0255129 by Curry, entitled "Firearm and air gun sight"; 2014/0096430 by Kruse, entitled "Gun sight with single point reference"; 2015/0153137 by Newzella et al, entitled "Fire control sight, had held firearm and a method for orienting a hand held firearm"; 2016/0146575 by Maynard, entitled "Forward framing gunsight" 2019/0145735 by Hancosky, entitled "Supplementary sight aid adaptable to existing and new sight aid"; 2020/0025514 by Johnson, entitled "Front sight for firearms"; and Des 382,038 by Nigh, entitled "Geometric firearm sight".

Additional artisans have proposed various combinations of particularly noteworthy illumination, stacking, sight geometry and other important considerations. Exemplary U.S. patents and published applications, the teachings which are incorporated herein by reference, include: U.S. Pat. No. 2,706,335 by Munsey, entitled "Gun sight"; U.S. Pat. No. 2,806,288 by Sarvis, entitled "Gun sights"; U.S. Pat. No. 3,187,436 by Friedrichsmeier, entitled "Contrasting color gun sight"; U.S. Pat. No. 3,499,224 by Squier et al, entitled "Gunsight"; U.S. Pat. No. 3,820,248 by Hayward, entitled "Illuminated gun sight"; U.S. Pat. No. 5,956,854 by Lorocco, entitled "Day/night weapon sight"; U.S. Pat. No. 6,360,471 by Stein, entitled "Aiming device for use on gun or other projectile-firing device"; U.S. Pat. No. 6,711,846 by Nasef, entitled "Gun sight system"; U.S. Pat. No. 6,769,210 by Bubits, entitled "Aiming device for pistols"; U.S. Pat. No. 7,308,891 by Graf, entitled "Products and processes for archery and firearm sights"; U.S. Pat. No. 7,451,566 by Price, entitled "Gun sight featuring point-to-point alignment"; U.S. Pat. No. 7,721,479 by Schulst, entitled "Sight for a handheld weapon"; U.S. Pat. No. 7,743,546 by Keng, entitled "Firearm adapted for use in low light, illuminating rear sight, and method for aligning sights in low light environments"; U.S. Pat. No. 7,946,075 by Nasef, entitled "Adjustable tactical gun sight"; U.S. Pat. No. 8,151,510 by Capson, entitled "Partial optical sighting device"; U.S. Pat. No. 8,863,433 by Kruse, entitled "Gun sight with single point reference"; U.S. Pat. No. 9,052,160 by Gordon, entitled "Front sight of a weapon"; and 2015/0192390 by Pedack et al, entitled "Small-arms weapon sight".

A very large body of patents disclose various geometries for scope reticles and interiors. Exemplary U.S. patents and published applications, the teachings which are incorporated herein by reference, include: U.S. Pat. No. 4,877,324 by Hauri et al, entitled "Optical sighting device with illuminated aiming mark"; U.S. Pat. No. 5,491,546 by Wascher et al, entitled "Laser assisted telescopic target sighting system and method"; U.S. Pat. No. 5,920,995 by Sammut, entitled "Gunsight and reticle therefor"; U.S. Pat. No. 6,032,374 by Sammut, entitled "Gunsight and reticle therefor"; U.S. Pat. No. 6,357,158 by Smith, entitled "Reticle-equipped telescopic gunsight and aiming system"; U.S. Pat. No. 6,453,595 by Sammut, entitled "Gunsight and reticle therefor"; U.S. Pat. No. 6,516,699 by Sammut et al, entitled "Apparatus and method for calculating aiming point information for rifle scopes"; U.S. Pat. No. 6,681,512 by Sammut, entitled "Gunsight and reticle therefor"; U.S. Pat. No. 6,802,131 by Scholz et al, entitled "Side-illuminated target structure having uniform ring illumination"; U.S. Pat. No. 7,603,804 by Zaderey et al, entitled "Ballistic reticle for projectile weapon aiming systems and method of aiming"; U.S. Pat. No. 7,654,029 by Peters et al, entitled "Ballistic ranging methods and systems for inclined shooting"; U.S. Pat. No. 7,676,137 by Schick et al, entitled "Optical sight"; U.S. Pat. No. 7,676,981 by Buckingham et al, entitled "Photoluminescent (PL) weapon sight illuminator"; U.S. Pat. No. 7,690,145 by Peters et al, entitled "Ballistic ranging methods and systems for inclined shooting"; U.S. Pat. No. 7,821,708 by Robitaille, entitled "Method and apparatus for illuminating a reticle"; U.S. Pat. No. 7,832,137 by Sammut et al, entitled "Apparatus and method for calculating aiming point information"; U.S. Pat. No. 7,856,750 by Sammut et al, entitled "Apparatus and method for calculating aiming point information"; U.S. Pat. No. 7,937,878 by Sammut et al, entitled "Apparatus and method for calculating aiming point information"; U.S. Pat. No. 8,009,958 by Schick et al, entitled "Optical sight"; U.S. Pat. No. 8,046,951 by Peters et al, entitled "Rangefinders and aiming methods using projectile grouping"; U.S. Pat. No. 8,091,268 by York, entitled "Multi-color reticle for ballistic aiming"; U.S. Pat. No. 8,109,029 by Sammut et al, entitled "Apparatus and method for calculating aiming point information"; U.S. Pat. No. 8,230,635 by Sammut et al, entitled "Apparatus and method for calculating aiming point information"; U.S. Pat. No. 8,254,746 by Schick et al, entitled "Optical sight"; U.S. Pat. No. 8,286,384 by Zaderey et al, entitled "Ballistic range compensation for projectile weapon aiming based on ammunition classification"; U.S. Pat. No. 8,353,454 by Sammut et al, entitled "Apparatus and method for calculating aiming point information"; U.S. Pat. No. 8,364,002 by Schick et al, entitled "Optical sight"; U.S. Pat. No. 8,448,372 by Peters et al, entitled "Rangefinders for inclined shooting of projectile weapons"; U.S. Pat. No. 8,656,630 by Sammut, entitled "Apparatus and method for aiming point calculation"; U.S. Pat. No. 8,707,608 by Sammut et al, entitled "Apparatus and method for calculating aiming point information"; U.S. Pat. No. 8,893,971 by Sammut et al, entitled "Apparatus and method for calculating aiming point information"; U.S. Pat. No. 8,905,307 by Sammut et al, entitled "Apparatus and method for calculating aiming point information"; U.S. Pat. No. 8,959,823 by Peters et al, entitled "Ranging methods for inclined shooting of projectile weapons"; U.S. Pat. No. 8,959,824 by Sammut et al, entitled "Apparatus and method for calculating aiming point information"; U.S. Pat. No. 8,966,806 by Sammut et al, entitled "Apparatus and method for calculating aiming point information"; U.S. Pat. No. 8,991,702 by Sammut et al, entitled "Apparatus and method for calculating aiming point information"; U.S. Pat. No. 9,068,794 by Sammut, entitled "Apparatus and method for aiming point calculation"; U.S. Pat. No. 9,091,507 by Paterson et al, entitled "Optical device having projected aiming point"; U.S. Pat. No. 9,115,958 by Crispin, entitled "Dual field optical aiming system for projectile weapons"; U.S. Pat. No. 9,222,753 by Hornung et al, entitled "Reticle for a telescope"; U.S. Pat. No. 9,250,038 by Sammut et al, entitled "Apparatus and method for calculating aiming point information"; U.S. Pat. No. 9,335,123 by Sammut, entitled "Apparatus and method for aiming point calculation"; U.S. Pat. No. 9,435,612 by Hancosky, entitled "Method and system for aligning a point of aim with a point of impact for a projectile device"; U.S. Pat. No. 9,482,489 by Peters et al, entitled "Ranging methods for inclined shooting of projectile weapon"; U.S. Pat. No. 9,568,277 by Crispin, entitled "Dual field optical aiming system for projectile weapons"; U.S. Pat. No. 9,574,850 by Sammut et al, entitled "Apparatus and method for calculating aiming point information"; U.S. Pat. No. 10,520,716 by Havens et al, entitled "Viewing optic with an integrated display system"; U.S. Pat. No. 10,900,745 by Hamilton et al, entitled "Dual focal plane reticles for optical sighting devices"; 2002/0124452 by Sammut, entitled "Gunsight and reticle therefor"; 2005/0229468 by Zaderey et al, entitled "Ballistic reticle for projectile weapon aiming systems and method of aiming"; 2007/0044364 by Sammut et al, entitled "Apparatus and method for calculating aiming point information"; 2007/0137088 by Peters et al, entitled "Ballistic ranging methods and systems for inclined shooting"; 2008/0098640 by Sammut et al, entitled "Apparatus And Method For Calculating Aiming Point Information"; 2009/0100735 by Schick et al, entitled "Optical sight"; 2009/0199451 by Zaderey et al, entitled "Ballistic reticle and riflescope for projectile weapon aiming system"; 2009/0199702 by Zaderey et al, entitled "Ballistic range compensation for projectile weapon aiming based on ammunition classification"; 2009/0200376 by Peters et al, entitled "Ballistic ranging methods and systems for inclined shooting"; 2009/0235570 by Sammut et al, entitled "Apparatus and method for calculating aiming point information"; 2010/0282845 by Peters et al, entitled "Rangefinders and aiming methods using projectile grouping"; 2011/0089238 by Sammut et al, entitled "Apparatus and method for calculating aiming point information"; 2011/0132983 by Sammut et al, entitled "Apparatus and method for calculating aiming point information"; 2011/0296733 by York, entitled "Multi colored reticle for ballistic aiming"; 2012/0137567 by Sammut, entitled "Apparatus and method for aiming point calculation"; 2012/0246992 by Peters et al, entitled "Rangefinders and aiming methods using projectile grouping"; 2013/0014421 by Sammut et al, entitled "Apparatus and method for calculating aiming point information"; 2013/0199074 by Paterson et al, entitled "Optical device having projected aiming point"; 2014/0007486 by Hornung et al, entitled "reticle for a telescope"; 2014/0041277 by Hamilton, entitled "Advanced illuminated reticle"; 2014/0059914 by Sammut et al, entitled "Apparatus and method for calculating aiming point information"; 2014/0059915 by Sammut et al, entitled "Apparatus and method for calculating aiming point information"; 2014/0109459 by Sammut et al, entitled "Apparatus and method for calculating aiming point information"; 2014/0123533 by Sammut et al, entitled "Apparatus and method for calculating aiming point information"; 2014/0360083 by Sammut, entitled "Apparatus and method for aiming point calculation"; 2015/0013206 by Peters et al, entitled "Ranging methods for inclined shooting of projectile weapons"; 2015/0020431 by Sammut et al, entitled "Apparatus and method for calculating aiming point information"; 2015/0198419 by Sammut, entitled "Apparatus and method for aiming point calculation"; 2015/0276346 by Hamilton et al, entitled "Dual focal plane reticles for optical sighting devices"; 2015/0362287 by Sammut et al, entitled "Apparatus and method for calculating aiming point information"; 2016/0061568 by Crispin, entitled "Dual field optical aiming system for projectile weapons"; 2016/0178321 by Peters et al, entitled "Ranging methods for inclined shooting of projectile weapon"; 2016/0377380 by Sammut, entitled "Apparatus and method for aiming point calculation"; 2019/0146205 by Havens et al, entitled "Viewing optic with an integrated display system"; U.S. Pat. No. 6,516,551 by Gaber, entitled "Optical sight with switchable reticle"; U.S. Pat. No. 7,100,320 by Verdugo, entitled "Reticule"; U.S. Pat. No. 7,434,345 by Verdugo, entitled "Reticule"; U.S. Pat. No. 7,685,760 by Neumaster, entitled "Paintball marker sight apparatus"; U.S. Pat. No. 7,793,456 by Lacorte, entitled "Gun sight reticle having adjustable sighting marks for bullet drop compensation"; U.S. Pat. No. 8,425,063 by Buckingham et al, entitled "Photoluminescent (PL) weapon sight illuminator"; U.S. Pat. No. 8,437,079 by Wu, entitled "Apparatus including a reticle, assembly and method for operating the same"; U.S. Pat. No. 8,769,858 by Hancosky et al, entitled "Method and system for aligning a point of aim with a point of impact for a projectile device"; U.S. Pat. No. 9,303,951 by Hancosky et al, entitled "Method and system for aligning a point of aim with a point of impact for a projectile device"; U.S. Pat. No. 9,696,115 by Nigro, entitled "Reticle providing maximized danger space"; U.S. Pat. No. 9,777,994 by Hancosky et al, entitled "Method and system for aligning a point of aim with a point of impact for a projectile device"; 2002/0078618 by Gaber, entitled "Optical sight with switchable reticle"; 2006/0026887 by Verdugo, entitled "Reticule"; 2007/0022651 by Verdugo, entitled "Reticle"; 2008/0295380 by Buckingham et al, entitled "Photoluminescent (pl.) weapon sight illuminator"; 2010/0170136 by Buckingham et al, entitled "Photoluminescent (pl.) weapon sight illuminator"; 2012/0047788 by Capson, entitled "Partial optical sighting device"; 2013/0263491 by Jung et al, entitled "Dot-sight device with polarizers"; 2013/0333266 by Gose et al, entitled "Augmented Sight and Sensing System"; 2015/0345905 by Hancosky, entitled "Method and system for aligning a point of aim with a point of impact for a projectile device"; 2016/0047624 by Hancosky, entitled "Method and system for aligning a point of aim with a point of impact for a projectile device"; 2016/0169620 by Nigro, entitled "Reticle providing maximized danger space"; and 2016/0178320 by Hancosky, entitled "Method and system for aligning a point of aim with a point of impact for a projectile device".

Additional patents of varying relevance, the relevant teachings and contents which are incorporated herein by reference, include: U.S. Pat. No. 3,700,339 by Steck, entitled "Gun sight"; U.S. Pat. No. 4,535,544 by Jones et al, entitled "Sighting apparatus"; U.S. Pat. No. 5,157,839 by Beutler, entitled "Illuminated rear peep sight for a bow"; U.S. Pat. No. 5,339,227 by Jones, entitled "Illuminator for archery aiming scope"; U.S. Pat. No. 6,604,315 by Smith et al, entitled "Method and apparatus for maintaining proper orientation of aiming eye when firing shotgun"; U.S. Pat. No. 7,739,825 by LoRocco, entitled "Illuminated sighting device"; and 2006/0096150 by Graf, entitled "Products and process for archery and firearm sights".

In addition to the foregoing patents, Webster's New Universal Unabridged Dictionary, Second Edition copyright 1983, is incorporated herein by reference in entirety for the definitions of words and terms used herein.

As may be apparent, in spite of the enormous advancements and substantial research and development that has been conducted, there still remains a need for a co-witnessed iron and red dot or reflex sight wherein the iron sight does not consequentially interfere with the function and operation of the red dot sight, while still preserving the inherent durability and availability afforded by the iron sight.

SUMMARY OF THE INVENTION

In a first manifestation, the invention is a firearm. A firearm body has a proximal end and a distal end. A gun barrel is configured for dispensing a projectile. A red dot sight comprises a sight window defining a shooter's sighted target field of view through the sight window, and a red dot sight mounting coupling to the firearm body. A gun sight optic contingency system has a low profile rear sight located proximate to the proximal end of the firearm body, below and outside of the shooter's sighted target field of view. A front sight is located proximate to the distal end of the firearm body and within the shooter's sighted target field of view. The rear sight and front sight in combination define a sighting axis aligned with a projectile path when a projectile is expelled from the firearm and further define a sight picture in relation to a target. A gun sight mounting couples the gun sight optic contingency system to the firearm. When the gun sight optic contingency system is co-witnessed with the red dot sight, such that when the red dot sight is aimed at a target, the front sight is visible within and adjacent to a bottom of the shooter's sighted target field of view, and the rear sight is outside of the shooter's sighted target field of view and adjacent to a bottom of the sight window and also adjacent to the front sight view visible in the shooter's sighted target field of view.

In a second manifestation, the invention is a firearm. A firearm body has a proximal end and a distal end. A gun barrel is configured for dispensing a projectile. A red dot sight comprises a sight window defining a shooter's sighted target field of view through the sight window, and a red dot displayed in the sight window, and a red dot sight mounting coupling to the firearm body. A gun sight optic contingency system has a low profile rear sight located proximate to the proximal end of the firearm body, below and outside of the shooter's sighted target field of view. A front sight is located proximate to the distal end of the firearm body and within the shooter's sighted target field of view. The rear sight and front sight in combination define a sighting axis aligned with a projectile path when a projectile is expelled from the firearm and further define a sight picture in relation to a target. A gun sight mounting couples the gun sight optic contingency system to the firearm. When the gun sight optic contingency system is co-witnessed with the red dot sight, such that when the red dot sight is aimed at a target and the red dot aligned in the sight picture with the target, the front sight is visible within and adjacent to a bottom of the shooter's sighted target field of view, and the rear sight is outside of the shooter's sighted target field of view and adjacent to a bottom of the sight window and also adjacent to and vertically aligned beneath the front sight view in the sight picture.

In a third manifestation, the invention is a gun sight for a pistol. A front iron sight has a pistol coupling and rises therefrom along a longitudinal axis to a front sight termination. A rear iron sight is configured to align vertically beneath the front iron sight in a sight picture. A reflex sight is intermediate between the front and rear iron sights, and is configured to align an illuminating dot adjacent the front sight termination in the sight picture. In the sight picture the front sight termination is aligned on the target and the rear iron sight is aligned vertically below the front iron sight, while a horizontal areas surrounding the front iron sight intermediate between the pistol coupling and the front sight termination remains visually unobstructed.

OBJECTS OF THE INVENTION

Exemplary embodiments of the present invention solve inadequacies of the prior art by providing a low profile iron sight that can be used in conjunction with a red dot sight, and that does not materially disrupt the viewing window of the red dot sight.

The present invention and the preferred and alternative embodiments have been developed with a number of objectives in mind. While not all of these objectives are found in every embodiment, these objectives nevertheless provide a sense of the general intent and the many possible benefits that are available from embodiments of the present invention.

A first object of the invention is to provide a fully functional red dot sight for use in combination with a firearm. A second object of the invention is to provide an iron sight that does not materially alter the performance and utility of the red dot sight, including the size of the sight window and the visibility of objects displayed therein, while still preserving the inherent durability and utility afforded by the iron sight. An additional object of the invention is to provide an optic contingency system for an optical sight such as but not solely limited to a red dot sight that is intuitive to sight and align to a target. A further object of the present invention is to provide a wide and unencumbered field of view of the target. As a corollary thereto, for many applications at least a portion of the area below the intended target impact location will also be as visible as possible. Another object of the invention is to have backup iron sights that function in low ambient light conditions. A further object of the present invention is to keep the primary red dot sight and backup iron sights co-witnessed such that a shooter doesn't require a substantial shift in the firearm to change from red dot to backup iron sights. Yet another object of the invention is to provide backup sights that allow a shooter to easily and quickly detect when there is a problem with the red dot sight.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 4:
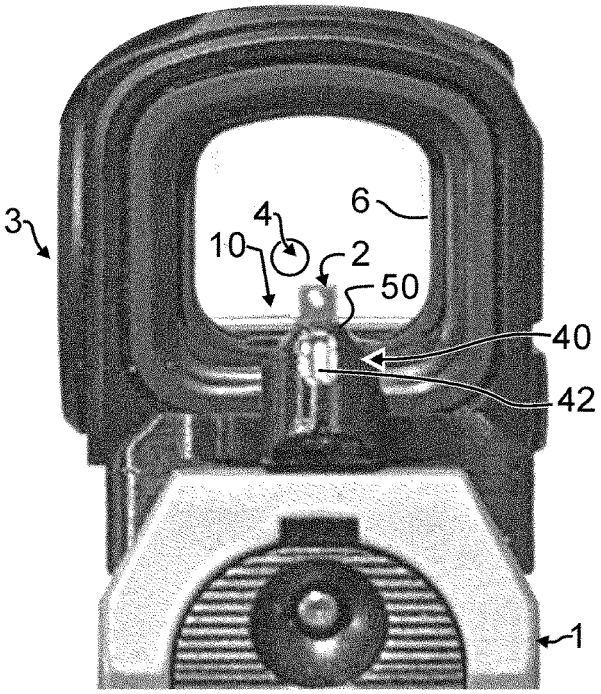
FIG. 4 illustrates the preferred embodiment rear iron sight of FIGS. 1 and 2 co-witnessed with a red dot sight to define a preferred embodiment gun sight optic contingency system, from a rear elevational view illustrating a relatively bright ambient light condition.
Figure 5:
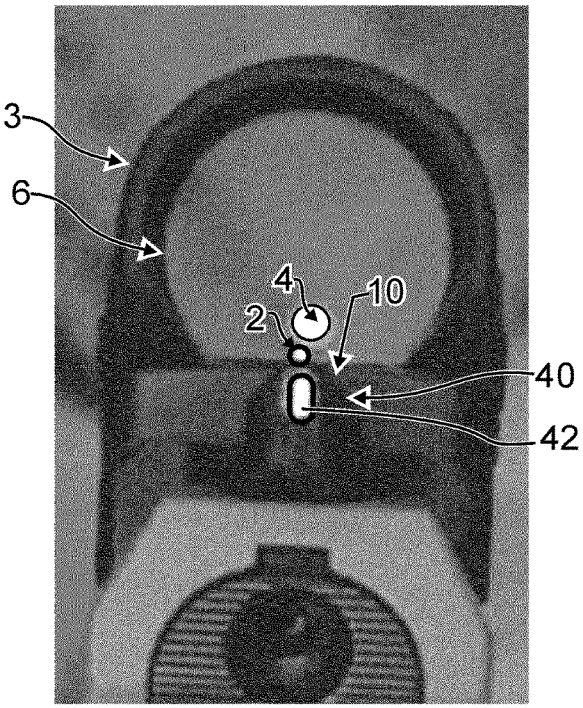
FIG. 5 illustrates the preferred embodiment gun sight optic contingency system of FIG. 4, from a rear elevational view illustrating a relatively low ambient light condition.

Manifested in the preferred embodiment, the present invention provides a gun sight contingency system for an optical sight. In the preferred embodiment of the invention as illustrated in FIGS. 1, 2, 4, and 5, gun sight optic contingency system 10 is comprised of an adaptor plate 20, an optic sight mounting surface 30 with suitable coupling points 32, and a glowing low profile rear sight 40 having a tritium view sight 42 and tritium vial port 44. In FIGS. 4 and 5, preferred embodiment gun sight optic contingency system 10 is mounted to a pistol 1 with a front iron sight 2 co-witnessed with a prior art red dot sight 3.

Figure 1:
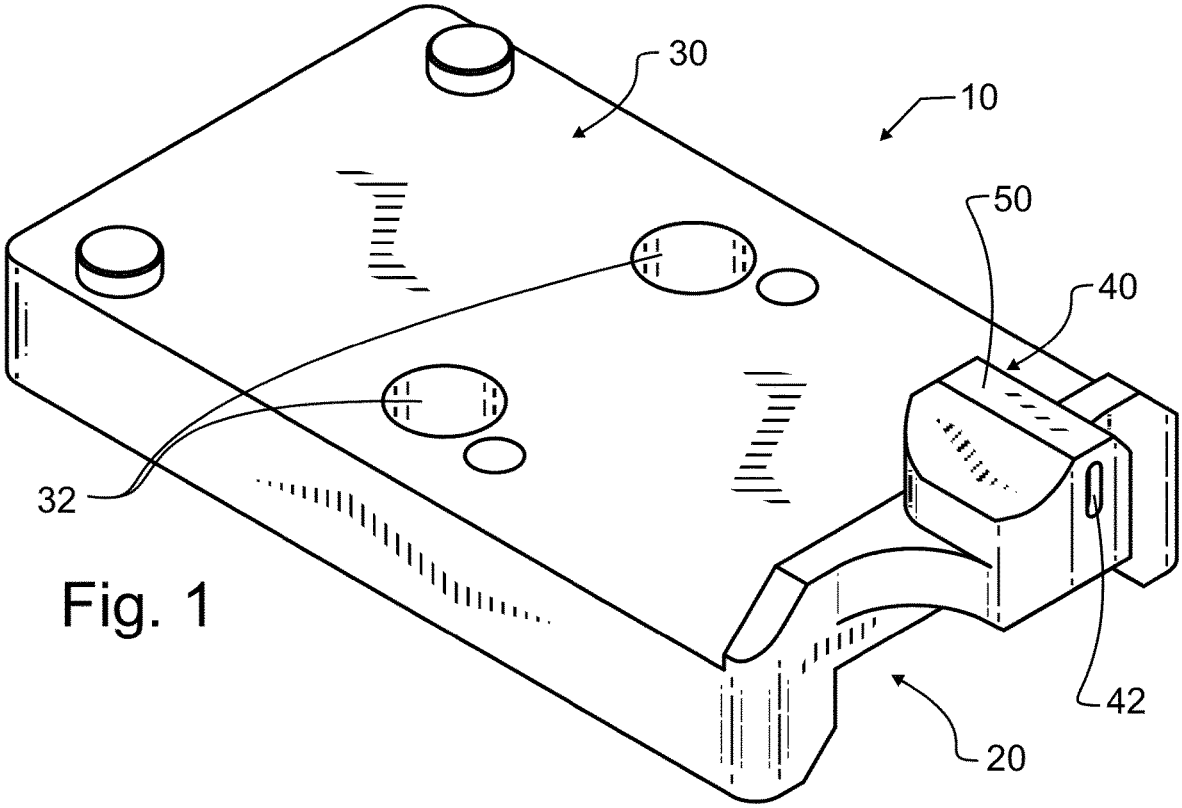
FIGS. 1 and 2 illustrate a preferred embodiment rear iron sight designed in accord with the teachings of the present invention, in combination with an adapter plate, from an elevated projected view and a front view respectively
Figure 2:
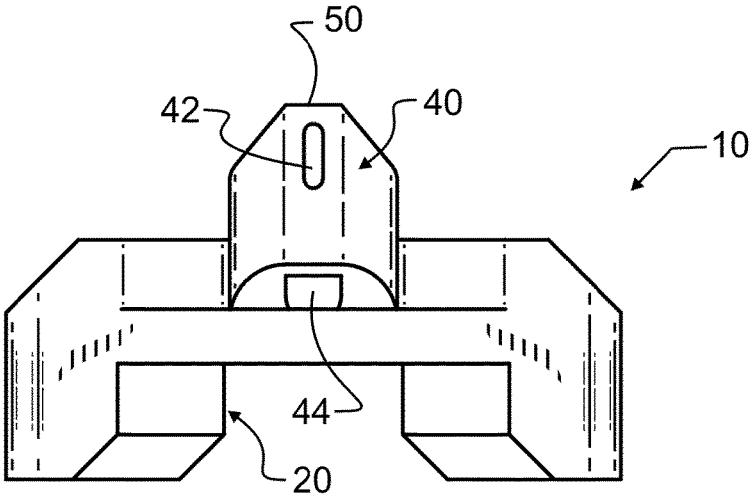
Figure 3:
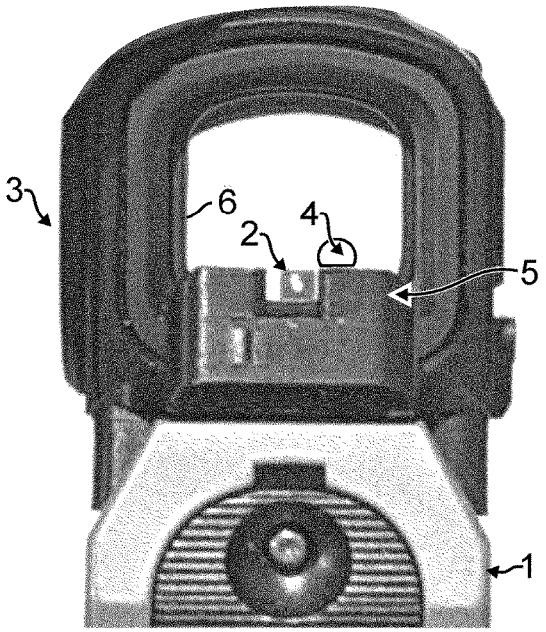
Fig. 3 Prior Art
FIG. 3 illustrates a prior art iron sight co-witnessed with a red dot sight.

Avery important feature of gun sight optic contingency system 10 is that the highest point 50 of the glowing low profile rear sight 40 remains below and outside of the sight window of red dot sight 6. The remainder of preferred embodiment gun sight optic contingency system 10 slopes down and/or away from the highest point 50 to, or at the elevation of optical sight mounting surface 30. This is important because it leaves the sight window 6 of the red dot sight 3 completely unobstructed by the glowing low profile rear sight 40 when red dot sight 3 is aligned with a target, thereby preserving the full capability and benefits of the red dot sight 3. In contrast thereto, prior art rear iron sight 5 of FIG. 3 partially obstructs the sight window 6 of the red dot sight 3 and therefore will also sometimes obstruct the shooter's view of red dot 4.

As known in the art of firearm sighting, alignment of front sight 2 is determined and set by the shooter in advance. Many shooters prefer to align the front sight to just beneath the intended target, since this leaves as much of the view of the target visible as possible. Nevertheless, in alternative embodiments some shooters will align the front sight to be aligned in blocking juxtaposition with the intended target. In either case, the large prior art notch geometries associated with the rear sight will necessarily increase the width of the rear sight, which in turn means more of the area immediately below the target spot will be obscured. This can be important both when trying to locate the red dot during the initial steps of sighting, and when an animate target might be moving and the lower portions are more likely to reveal or indicate that movement.

While not necessary for all applications, in some intended applications such as in law enforcement or self defense, knowing if something down range changes can be vital. For exemplary and non-limiting purpose, when a suspect or perpetrator holds their hands down so that they either can draw or drop a weapon, or present some other type of threat or cease a threat, then not being able to see and be aware will increase the likelihood of mortal consequence to either the shooter or perpetrator. Consequently, in some instances a shooter will need to be able to see as much as possible below a target.

Front iron sight 2 will be selected by a designer or shooter to meet a particular set of needs or desires. Consequently, front iron sight 2 in various embodiments will be selected to have different heights, the height which corresponds to an elevational displacement transverse to and spaced from the gun barrel axis. For most embodiments, this height will also correspond to the longitudinal or longest axis of the sight. Changing the height of the front sight will of course also need to be associated with a height that the target will appear in the optic sight. In other words, and to state the obvious, to keep both the iron sights and optical sight aligned, when one is displaced the other will need to be as well.

In addition, front iron sight 2 in various embodiments will be selected to have a tritium vial in the narrowest (measured in a plane transverse to the axis of the gun barrel) front sight permitted by the NRC. As is apparent, the narrower that front iron sight 2 is, the less the lower field of view is obstructed. This in turn means more visibility of the area below the target.

A very significant benefit of low profile front iron sight 2 and glowing low profile rear sight 40 co-witnessed with red dot sight 3 arises when red dot sight 3 fails due to a low battery or other malfunction. In such cases, the iron sights 2, 40 are still active and can be used by a shooter to essentially instantaneously verify failure of the red dot sight 3, while still providing accurate and capable sights without having to reposition pistol 1. This is accomplished while simultaneously leaving the red dot sight window 6 unobstructed.

Preferred embodiment glowing low profile rear sight 40 also preferably has a tritium view sight 42 incorporating a tritium vial into tritium vial port 44. Preferably, front iron sight 2 is also glowing, such as through similar provision of a luminescent composition such as a radio-luminescent light source, so that the glowing dots of both the front iron sight 2 and the tritium view sight 42 are aligned. This combination enables low ambient light utilization of preferred embodiment gun sight optic contingency system 10 and pistol 1, as illustrated in FIG. 5. While a generally circular dot is illustrated for front iron sight 2 in FIG. 5 and an elongated shape is illustrated for tritium view sight 42, it will be understood that different geometries will be used for each in different alternative embodiments. In some alternative embodiments, front iron sight 2 may incorporate an elongate tritium view sight resembling that of tritium view sight 42. This can be particularly beneficial when front iron sight 2 is also relatively more elongated and extends more interiorly into the view window of red dot sight 3.

When the ambient light levels are high, meaning the environment is very bright, the radio-luminescent vials will appear as relatively white or chalky areas within the iron sights 2, 40. In preferred embodiment gun sight optic contingency system 10, the metal portions of iron sights 2, 40 are fabricated to have sufficient contrast with these relatively whiter vials so that the location of the vials and thus the ability to accurately sight the gun remain, regardless of ambient light conditions. In some embodiments, the border of the metal adjacent to the tritium view sights such as view sight 42 are treated or coated to produce a white border or visual ring or circle around the tritium view sight 42. A white ring border is preferable, since it is easily distinguished from the common red and green used for red dot sights, even in those individuals with red-green color blindness, and is also visually distinct from the surface finish of the metal that makes up the support for the tritium vials.

In preferred embodiment gun sight optic contingency system 10, view sight 42 is oriented essentially vertically, or perpendicular or normal to adapter plate 20. However, in some alternative embodiments this angular orientation is changed to a less-than perpendicular orientation. In some of these alternative embodiments, the bottom of view sight 42 is closer to the shooter's eye than the top. This creates perspective for the shooter that can be beneficial in some instances.

From the foregoing figures and description, several additional features and options become more apparent. First of all, gun sight optic contingency system 10 may be manufactured from a variety of materials, including metals, resins and plastics, ceramics or cementitious materials, or even combinations or composites of the above. The specific material used may vary, though special benefits are attainable if the most important factor is taken into consideration.

Because of US Nuclear Regulatory Commission requirements and similar requirements that may be found in various locales, gun sight optic contingency system 10 needs to protect the tritium vial which is visible through tritium view sight 42, as the vial contains a radioactive material that should not be released. One such requirement is a minimum dimension requirement for the border around the vial. For like reason, it is preferable that critical materials used in the fabrication of gun sight optic contingency system 10 are sufficiently tough and durable to not fracture, even when great forces are applied thereto, including the firing of the pistol 1, or the accidental dropping of pistol 1. In the case of gun sight optic contingency system 10, a preferred material is metal, which has the advantages of being extremely tough and durable and capable of withstand great forces and can be machined or otherwise fabricated to retain the tritium vial using techniques known in the industry. In addition to, or instead of a tritium vial, in some alternative embodiments tritium view sight 42 will comprise a combination or alternative luminescent light source such as: a radio-luminescent material; a phosphorescent material which may be charged utilizing an external or internal light source; or an optic fiber which collects ambient light and focuses it on a single area. While other luminescent sources may be provided, including for exemplary and non-limiting purposes electrical sources such as light-emitting diodes or electro-chromic light sources, the use of a material such as tritium is much preferred owing to the long term no-maintenance extremely high reliability of such a light source.

The combination of a prior art pistol 1 and preferred embodiment gun sight optic contingency system 10 is most preferred. Nevertheless, in some alternative embodiments other types of firearms will incorporate the preferred embodiment gun sight optic contingency system 10. Adapter plate 20 provides a convenient way to couple red dot sights of different geometries and mounting configurations onto diverse pistols and other firearms. Nevertheless, preferred embodiment gun sight optic contingency system 10 does not require the inclusion of the adapter plate. Consequently, in some alternative embodiments one or more of the iron sight components are affixed directly to the firearm. In other alternative embodiments, one or more of the iron sight components are formed unitarily with the firearm.

The present invention not only benefits by keeping as much of the red dot sight view window open as possible, it also provides benefit biomechanically. Describing a preferred embodiment shooting method using preferred embodiment gun sight optic contingency system 10, a shooter will raise pistol 1 such that the sights 2, 3, 40 are aligned well above the intended target. As with the prior art co-witnessed sights of FIG. 3, this allows a shooter to see front iron sight 2 and over both of the red dot sight 3 and rear iron sight 40. Then they squeeze the grip with their pinky finger, which pulls the shot elevation down, bringing the red dot and iron sights into alignment with the target. This works well when red dot sight 3 is working. Since the red dot sight 3 only requires alignment of two objects, the dot 4 and the target, this alignment is very fast. Consequently, red dot sight 3 is almost always the primary sight.

When the iron backup sight is needed, the shooter will have already squeezed their pinky finger about the grip, and then they realize that red dot sight 3 is malfunctioning and red dot 4 is not visible. In sharp contrast to prior art FIG. 3, the shooter knows the red dot sight 3 is malfunctioning essentially immediately, since preferred embodiment gun sight optic contingency system 10 is aligned, and red dot 4 is nowhere to be seen. When the shooter realizes that red dot 4 is not there, then the shooter has to find a point of aim. "Point of aim" is defined by front iron sight 2. Since glowing low profile rear sight 40 does not block the view of front sight 2, there will be many fewer times that a shooter will need to raise the muzzle end of pistol 1 to find front iron sight 2 and repeat the targeting procedure. Instead, the very alignment of rear sight 40 with front iron sight 2 that informs the shooter that red dot sight 3 has failed will also allow the shooter to immediately switch to preferred embodiment gun sight optic contingency system 10 to align pistol 1 to an intended target, without the need for much or any further movement of pistol 1 by the shooter.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims hereinbelow.

We claim:

1. A firearm, comprising:

a firearm body having a proximal end and a distal end;

a gun barrel for dispensing a projectile;

a red dot sight having a sight window defining a shooter's sighted target field of view through said sight window, and a red dot sight mounting coupling to said firearm body;

a gun sight optic contingency system having a low profile rear sight located proximate to said proximal end of said firearm body, below and outside of said shooter's sighted target field of view, a front sight located proximate to the distal end of said firearm body and within said shooter's sighted target field of view, said rear sight and said front sight in combination defining a sighting axis aligned with a projectile path when a projectile is expelled from said firearm and further defining a sight picture in relation to a target; and a gun sight mounting coupling to said firearm;

wherein said gun sight optic contingency system is co-witnessed with said red dot sight such that when said red dot sight is aimed at said target, said front sight is visible within and adjacent to a bottom of said shooter's sighted target field of view, and said rear sight is outside of said shooter's sighted target field of view and adjacent to a bottom of said sight window and also adjacent to said front sight view visible in said shooter's sighted target field of view.

2. The firearm of claim 1, wherein said rear sight is vertically aligned beneath said front sight view when said sighting axis is aligned with said target in said sight picture.

3. The firearm of claim 1, wherein said gun sight optic contingency system further comprises luminescent materials on said gun sight optic contingency system to provide low light aim assistance.

4. The firearm of claim 3, wherein said rear sight further comprises:

a radio-luminescent vial contained within said rear sight; and a rear view sight exposing said radio-luminescent material.

5. The firearm of claim 4, wherein said rear view sight has a longitudinal axis extending radially beneath said front sight in said sight picture.

6. The firearm of claim 5, wherein said rear view sight longitudinal axis is perpendicular to said sighting axis.

7. The firearm of claim 1, wherein said rear view sight longitudinal axis is intermediate between perpendicular to and parallel with said sighting axis.

8. The firearm of claim 4, wherein said rear view sight further comprises a circumferential border having a color contrasting with a red dot displayed within said sight window and contrasting with a color of said rear sight outside of said circumferential border.

9. The firearm of claim 3, wherein said front sight further comprises:

a radio-luminescent vial contained within said front sight; and a front view sight exposing said radio-luminescent material.

10. The firearm of claim 3, wherein said front view sight has a longitudinal axis extending radially beneath said target in said sight picture.

11. The firearm of claim 10, wherein said front view sight longitudinal axis is perpendicular to said sighting axis.

12. The firearm of claim 10, wherein said front view sight longitudinal axis is intermediate between perpendicular to and parallel with said sighting axis.

13. The firearm of claim 9, wherein said front view sight further comprises a circumferential border having a color contrasting with a red dot displayed within said sight window and contrasting with a color of said front sight outside of said circumferential border.

14. A firearm, comprising:

a firearm body having a proximal end and a distal end; and a gun barrel for dispensing a projectile;

a red dot sight having a sight window defining a shooter's sighted target field of view through said sight window, a red dot displayed in said sight window, and a red dot sight mounting coupling to said firearm body;

a gun sight optic contingency system having a low profile rear sight located proximate to said proximal end of said firearm body, below and outside of said shooter's sighted target field of view, a front sight located proximate to the distal end of said firearm body and within said shooter's sighted target field of view, said rear sight and said front sight in combination defining a sighting axis aligned with a projectile path when a projectile is expelled from said firearm and further defining a sight picture in relation to a target; and a gun sight mounting coupling to said firearm;

wherein said gun sight optic contingency system is co-witnessed with said red dot sight such that when said red dot sight is aimed at said target and said red dot aligned in said sight picture with said target, said front sight is visible within and adjacent to a bottom of said shooter's sighted target field of view, and said rear sight is outside of said shooter's sighted target field of view and adjacent to a bottom of said sight window and also adjacent to and vertically aligned beneath said front sight view in said sight picture.

15. The firearm of claim 14, wherein said gun sight optic contingency system further comprises luminescent materials on said gun sight optic contingency system to provide low light aim assistance.

16. The firearm of claim 15, wherein said rear sight further comprises:

a radio-luminescent vial contained within said rear sight; and a rear view sight exposing said radio-luminescent material;

wherein said front sight further comprises:

a radio-luminescent vial contained within said front sight; and a front view sight exposing said radio-luminescent material;

wherein said rear view sight has a longitudinal axis extending radially beneath said front sight in said sight picture; and wherein said front view sight has a longitudinal axis extending radially beneath said target in said sight picture, said rear view sight longitudinal axis aligned with said front view sight longitudinal axis in said sight picture.

17. A gun sight for a pistol, comprising:

a front iron sight having a pistol coupling and rising therefrom along a longitudinal axis to a front sight termination;

a rear iron sight configured to align vertically beneath said front iron sight in a sight picture; and a reflex sight intermediate between said front and rear iron sights, and configured to align an illuminating dot adjacent said front sight termination in said sight picture;

wherein in said sight picture said front sight termination is aligned on said target and said rear iron sight is aligned vertically below said front iron sight, while a horizontal areas surrounding said front iron sight intermediate between said pistol coupling and said front sight termination remain visually unobstructed.

18. The firearm of claim 17, wherein said rear sight further comprises:

a radio-luminescent vial contained within said rear sight; and a rear view sight exposing said radio-luminescent material;

wherein said front sight further comprises:

a radio-luminescent vial contained within said front sight; and a front view sight exposing said radio-luminescent material;

wherein said rear view sight has a longitudinal axis extending radially beneath said front sight in said sight picture; and wherein said front view sight has a longitudinal axis extending radially beneath said target in said sight picture, said rear view sight longitudinal axis aligned with said front view sight longitudinal axis in said sight picture.

* * * * *